US007600566B2

(12) United States Patent
Hoffman et al.

(10) Patent No.: US 7,600,566 B2
(45) Date of Patent: Oct. 13, 2009

(54) COLLAR LOCATOR FOR SLICK PUMP

(75) Inventors: Corey E. Hoffman, Magnolia, TX (US); Leonard I. Casey, Jr., The Woodland, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 162 days.

(21) Appl. No.: 11/291,299

(22) Filed: Dec. 1, 2005

(65) Prior Publication Data

US 2006/0081380 A1 Apr. 20, 2006

Related U.S. Application Data

(63) Continuation-in-part of application No. 10/737,703, filed on Dec. 15, 2003, now Pat. No. 7,172,028.

(51) Int. Cl.
*E21B 23/00* (2006.01)
*E21B 43/16* (2006.01)

(52) U.S. Cl. ..... 166/255.1; 166/106; 166/64

(58) Field of Classification Search ..... 166/64, 166/106, 255.1
See application file for complete search history.

(56) References Cited

U.S. PATENT DOCUMENTS

| | | | | |
|---|---|---|---|---|
| 2,217,043 | A | 10/1940 | Boynton | |
| 2,624,412 | A | 1/1953 | Ragan | |
| 2,684,639 | A * | 7/1954 | Stutton | 417/260 |
| 2,695,065 | A | 11/1954 | Baker et al. | |
| 2,703,623 | A | 3/1955 | Baker | |
| 2,829,716 | A | 4/1958 | Stewart | |
| 2,942,666 | A | 6/1960 | Boer et al. | |
| 2,948,231 | A * | 8/1960 | Hart | 417/439 |
| 2,966,121 | A * | 12/1960 | Crowl | 92/87 |
| 3,134,441 | A | 5/1964 | Barry et al. | |
| 3,139,140 | A | 6/1964 | Brown | |
| 3,147,809 | A * | 9/1964 | Thomas | 166/98 |
| 3,176,304 | A | 3/1965 | Carlton et al. | |
| 3,344,861 | A | 10/1967 | Claycomb | |
| 3,381,750 | A * | 5/1968 | Brown | 166/64 |
| 3,510,234 | A | 5/1970 | Wolf | |
| 3,876,000 | A | 4/1975 | Nutter | |
| 3,902,361 | A * | 9/1975 | Watson | 73/152.57 |
| 3,923,099 | A * | 12/1975 | Brandon | 166/249 |
| 3,926,254 | A | 12/1975 | Evans et al. | |
| 3,926,260 | A | 12/1975 | Slator | |

(Continued)

FOREIGN PATENT DOCUMENTS

| | | |
|---|---|---|
| EP | 0 518 371 | 12/1992 |

(Continued)

OTHER PUBLICATIONS

GB Prelim. Exam and Search Report, Application No. 0623533.7, Dated Mar. 13, 2007.

*Primary Examiner*—Shane Bomar
(74) *Attorney, Agent, or Firm*—Patterson & Sheridan, L.L.P.

(57) ABSTRACT

A method and apparatus for actuating a downhole tool at a desired location. A reciprocating hydraulic slickline pump with a locator is provided. The pump comprises a pump member. The pump member is reciprocated axially by slickline in order to form an upstroke and downstroke. The pump is configured such that it pressurizes fluid within a workstring assembly during the pump's downstroke.

21 Claims, 8 Drawing Sheets

U.S. PATENT DOCUMENTS

| | | | | |
|---|---|---|---|---|
| 4,139,334 | A | 2/1979 | Payne et al. | |
| 4,190,113 | A | 2/1980 | Harrison | |
| 4,320,800 | A | 3/1982 | Upchurch | |
| 4,505,155 | A | 3/1985 | Jackson | |
| 4,592,421 | A | 6/1986 | Hoffmann et al. | |
| 4,940,092 | A | 7/1990 | Ferguson et al. | |
| 5,228,519 | A | 7/1993 | Coronado et al. | |
| 5,660,534 | A | 8/1997 | Snow | |
| 5,791,412 | A | 8/1998 | Myhre | |
| 6,012,518 | A * | 1/2000 | Pringle et al. | 166/66.4 |
| 6,371,008 | B1 | 4/2002 | Djelouah | |
| 6,497,561 | B2 | 12/2002 | Skillman | |
| 6,896,056 | B2 * | 5/2005 | Mendez et al. | 166/254.2 |
| 6,915,856 | B2 | 7/2005 | Gentry et al. | |
| 7,172,028 | B2 | 2/2007 | Barbee et al. | |
| 2002/0185274 | A1 * | 12/2002 | Simpson et al. | 166/277 |

FOREIGN PATENT DOCUMENTS

| | | |
|---|---|---|
| EP | 0730083 | 9/1996 |
| GB | 2 337 065 | 11/1999 |
| GB | 2409244 | 6/2005 |

* cited by examiner

COLLAR LOCATOR FOR SLICK PUMP

CROSS-REFERENCE TO RELATED APPLICATIONS

This application is a continuation-in-part of U.S. patent application Ser. No. 10/737,703, filed Dec. 15, 2003, now U.S. Pat. No. 7,172,028. The aforementioned related patent application is herein incorporated in its entirety by reference.

BACKGROUND OF THE INVENTION

1. Field of the Invention

The present invention generally relates to fluid actuated downhole tools. More particularly, the invention relates to a locator used in conjunction with a pumping apparatus used for activating downhole tools by providing pressurized fluid. More particularly still, embodiments of the invention pertain to a locator for a reciprocating hydraulic slickline pump.

2. Description of the Related Art

It is often necessary to deploy and actuate downhole equipment and tools, including packers and bridge plugs, during the completion or remediation of a well. Downhole hardware may be deployed and actuated using various conveying members including drill pipe, coiled tubing or spoolable line, such as wireline and slickline. Drill pipe and coiled tubing are physically larger and have greater strength than wireline and slickline. However, the cost and time requirements associated with procuring and running drill pipe or coiled tubing are much greater than those of spoolable line. Therefore, whenever appropriate, use of spoolable line is preferred.

Wireline and slickline are among the most utilized types of spoolable line. Wireline consists of a composite structure containing electrical conductors in a core assembly which is encased in spirally wrapped armor wire. Typically, wireline is used in applications where it facilitates the transportation of power and information between downhole equipment and equipment at the surface of the well.

Slickline, on the other hand, is mainly used to transport hardware into and out of the well. Slickline, designed primarily for bearing loads, is of much simpler construction and does not have electrical conductors like those in wireline. Instead, slickline is a high quality length (sometimes up to 10000 feet or more) of wire which can be made from a variety of materials, (from mild steel to alloy steel) and is produced in a variety of sizes. Typically, slickline comes in three sizes: 0.092; 0.108; and 0.125 inches in diameter. For larger sizes, a braided wire construction is utilized. The braided wire, for all practical purposes, has similar functional characteristics as a solid wire. Such braided wire is considered to be slickline herein.

As stated above, use of wireline and slickline for deploying and actuating downhole tools is preferred over the use of drill pipe and coiled tubing due to the relatively low expense. Further, use of slickline is preferred over wireline, because slickline based systems are simpler and less expensive than wireline.

When performing operations within a wellbore it is often necessary to know the location of the tool. In wireline and slickline operations it is common to measure the amount of line extended into the wellbore. This is typically done by passing the line over a calibrated measuring wheel at the surface of the well. As the tool is deployed, the length of the line unspoolled into the well is monitored and used as an estimate of tool depth. Stretch and twisting of the line downhole can cause inaccuracies in measured versus actual depth. Such inaccuracies can make it difficult to know the exact depth of the tool. Further, when running tools to a destination downhole, it is advantageous to know the location of the nearest casing coupling, which cannot be determined accurately by measuring the amount of cable let out at the surface.

When setting a packer to seal a wellbore it is advantageous that the packer sets in the smooth inner diameter of the casing, and not at a casing coupling. The inner diameter at a casing coupling is irregular and larger than the inner diameter of the rest of the casing. Thus, if a packer sets at a casing coupling the seal is often in jeopardy due to the inner diameter irregularities.

It is known to use locators in conjunction with a tool lowered on the wireline. These locators are often collets which send data to an operator at the surface. The collet informs the operator of the location of casing couplings as the tool reaches them. Thus an operator may record the location of the casing couplings in conjunction with the unspoolled line to get a more accurate determination of depth.

Many of the tools deployed during well completion and remediation, such as packers and bridge plugs, for example, are actuated by increased fluid pressure in the wellbore or by explosives. Often, downhole electric pumps are utilized to provide the increased pressure. Use of electric pumps run on wireline is common, but the pumps are complex and very expensive.

Therefore, there is a need for a locator for use in conjunction with a simple and reliable hydraulic pump that can be run on slickline and can be used to deploy hydraulically actuated tools. There is a further need for the pump to be operated by axially reciprocating the slickline.

SUMMARY OF THE INVENTION

One aspect includes locating a tool in a wellbore by providing an assembly having a tool, a pump, and a locator. Then, running the assembly into the wellbore on a cable, monitoring the locator, and measuring a length of cable deployed. Then, correlating the measuring and the monitoring. Then, actuating the tool at a desired depth by manipulating the cable.

Another aspect includes an apparatus for locating a tool in a wellbore having a workstring assembly and a cable. The cable is for conveying the workstring assembly into the wellbore. The workstring assembly has a tool and a pump. The pump has a chamber and a piston to compress the chamber. The piston is operated by adjusting a force in the cable that the pump is conveyed on; and a locator for identifying a feature in the wellbore.

BRIEF DESCRIPTION OF THE DRAWINGS

So that the manner in which the above recited features, the advantages and objects for the present invention can be more fully understood, certain embodiments of the invention are illustrated in the appended drawings.

DETAILED DESCRIPTION OF THE PREFERRED EMBODIMENT

The apparatus and methods of the present invention allow for the locating and actuation of downhole tools such as packers and bridge plugs using a hydraulic pump run on slickline and operated by reciprocating the slickline.

The discussion below focuses primarily on utilizing slickline to deploy, locate and actuate downhole tools such as packers and bridge plugs. The principles of the present invention also allow for the use of any conveyance string including cable, examples of cable type conveying members including a wireline, a slickline, braided wire, Dyformed cable and swab line. Further, in another embodiment the conveyance string could be a coiled tubing or Co Rod which is a solid small diameter rod.

Figure 1:
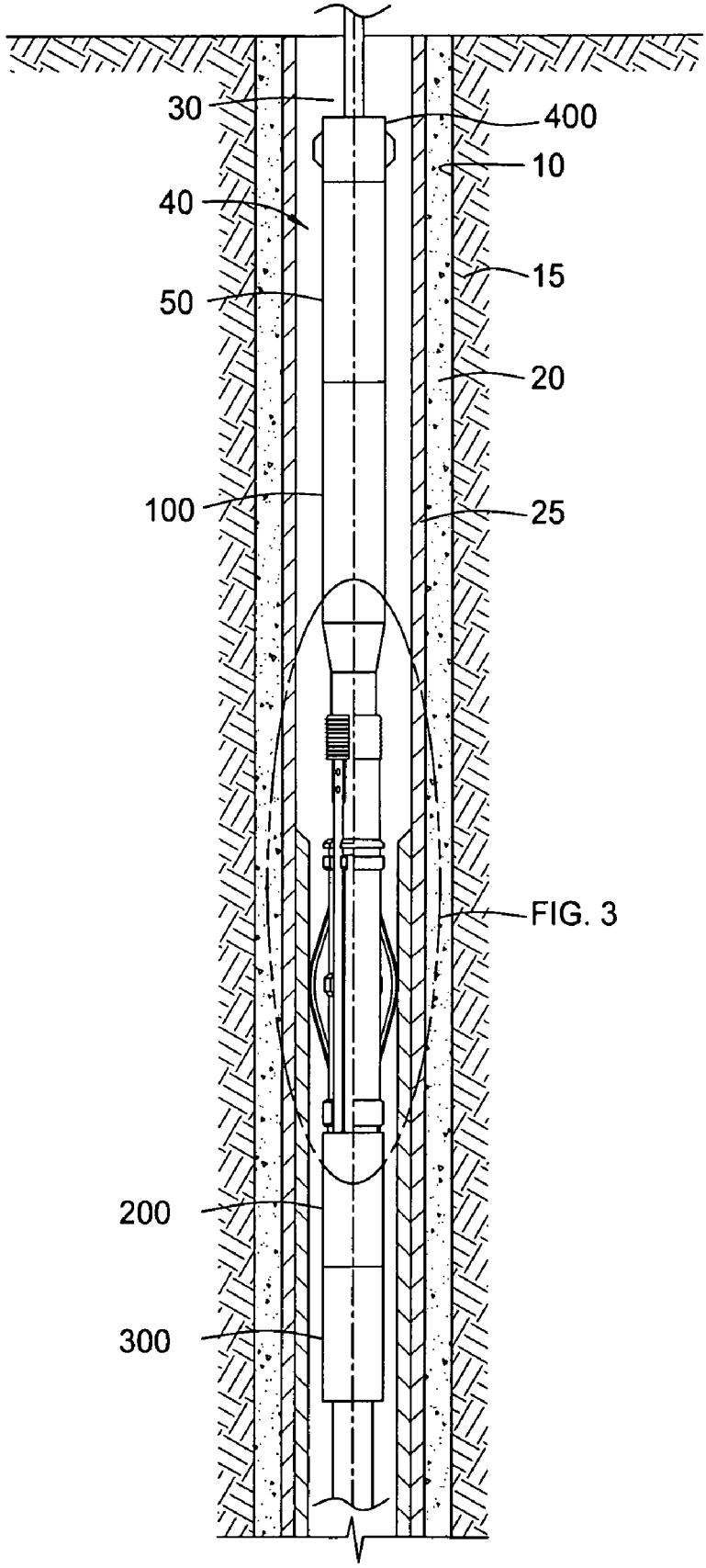
FIG. 1 is a cross-sectional view of a wellbore illustrating the slickline pump of the present invention lowered into the wellbore as a part of a downhole assembly.

FIG. 1 presents a cross-sectional view of a wellbore 10. As illustrated, the wellbore 10 has a string of casing 25 fixed in formation 15 by cured cement 20. The wellbore 10 also includes an axially reciprocating slickline pump 100 of the present invention, in a first embodiment.

The pump 100 is shown as a component of a work string assembly 40 that is threadedly connected to slickline 30 above. The slickline 30 is provided and controlled from a surface slickline unit 450, shown schematically in FIG. 5. Along with the slickline pump 100, the work string assembly 40 comprises a locator 400, a weight stem 50, one or more hydraulic multipliers 200, and a downhole tool 300, such as a packer or bridge plug that will be set or actuated or both. All components of the work string assembly 40 may be threadedly connected to each other.

Depending on the type of pump anchoring system used, a downward force parallel to the axis of the wellbore 10 may be required to position the workstring assembly 40 at the desired location in the wellbore 10. Further, another downward force is needed to operate the pump 100. Due to the characteristics of cables, a slickline can only exert an upward force on the work string assembly 40 based on the tension in the line. A downward force can not be provided by slickline, alone. However, with the use of weighted members, or weight stem 50, the desired amount of downforce can be applied by choosing the appropriate combination of weight stem 50 in the work string assembly 40 and tension in the slickline 30.

For example, suppose the workstring assembly 40 is anchored and is no longer supported axially by the slickline 30. Further suppose the weight stem weighs 5000 lbs and a 2000 lbs downward force is needed to properly stroke the pump 100. The tension in the slickline is 5000 lbs, based on the weight of the weight stem. During the downstroke, a tension of only 3000 lbs would be maintained. As a result, the remaining 2000 lbs of weight stem that has not been counteracted by tension in the slickline 30, provides a downward force on the pump 100. On the upstroke, the tension in the slickline would be raised to 5000 lbs, which accounts for all the weight of the weight stem, allowing the pump to extend completely.

The pump 100 is located directly below the weight stem 50. The pump 100 transforms the reciprocating motion, consisting of down-strokes and upstrokes, and produces a hydraulic pressure that is relayed to the remainder of the work string assembly 40 below. Components of the pump 100 and its operation are discussed in detail in a later section.

The pressure produced by the pump 100, may not be adequate to actuate the downhole tool 300. Therefore, for the purposes of amplifying the pressure produced by the pump 100, one or more hydraulic multipliers 200 may be connected below the pump 100. Hydraulic multipliers 200 are commonly known in the industry for taking an intake pressure and producing a higher pressure as output. The number of multipliers 200 used depends on the desired pressure increase.

The downhole tool 300 to be deployed and actuated is located below the hydraulic multipliers 200. For the embodiment shown, the downhole tool is an inflatable packer. Those skilled in the art will recognize that a variety of tools activated by pressure may be set or actuated by the pump 100 of the present invention. As used herein, the terms downhole tool may refer to an array of tools including packers and bridge plugs.

Figure 2:
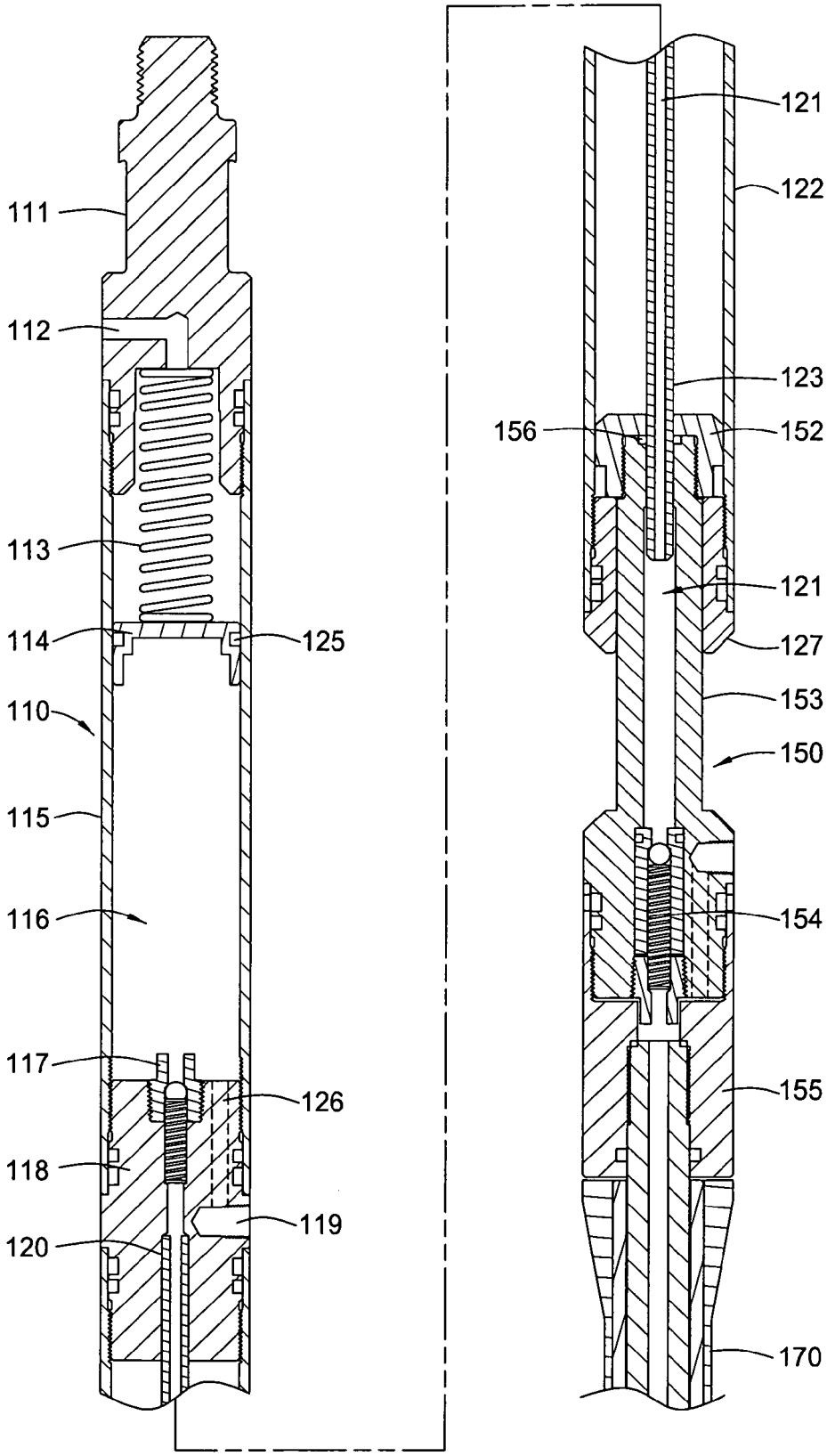
FIG. 2 is a cross-sectional view of one embodiment of a slickline pump of the present invention.

A cross-sectional view of the slickline pump 100 is shown in greater detail in FIG. 2. As illustrated in FIG. 2, the pump 100 comprises a barrel assembly 110, mandrel assembly 150, and an anchor assembly 170.

Located at the top of the barrel assembly 110 is a top sub 111 that is used to threadedly connect the pump 100 to the weight stem 50 members above. An upper barrel 115 is threadedly connected below the top sub 111. A barrel sub 118 is positioned below the upper barrel 115 and above a lower barrel 122; the barrel sub 118 is threadedly connected to both the upper barrel 115 and lower barrel 122. At the bottom of the barrel assembly 110, a barrel stop 127 is threadedly connected to the lower barrel 122.

A piston spring 113 and floating piston 114 are located within the area bounded by the top sub 111, barrel sub 118, and upper barrel 115. The lower portion of the top sub 111 contains a downward facing bore that accepts the piston spring 113. The top sub 111 also includes a vent 112 designed to allow wellbore fluid, pressurized due to the hydrostatic head, into the top sub 111. A piston seal 125 is provided to ensure the pressurized wellbore fluid remains above the floating piston 114.

The region between the floating piston 114 and the barrel sub 118 is filled with fluid forming a fluid reservoir 116. In one embodiment, the fluid used may be hydraulic fluid. During assembly of the pump 100, hydraulic fluid is added to the fluid reservoir 116 via a port 126 in the barrel sub 118. After the desired amount of fluid is added, a plug 119 is inserted to close the port 126 and retain the fluid.

The piston spring 113, assisted by the wellbore fluid above the floating piston 114, provides a constant force on the floating piston 113, which in turn will ensure the fluid reservoir 116 is pressurized to a level greater than or equal to the hydrostatic head. Even though the pressure of the fluid reservoir is increased it will not be high enough to open an upper check valve 117 located within the barrel sub 118. The upper check valve 117 assembly comprises a ball, ball seat, and spring. In this specification, check valves are intended to permit fluid travel only in one direction. Operation of the upper check valve 117 will be described in detail in a later section.

In another embodiment (not shown), the fluid reservoir 116 may not be isolated from the wellbore 10. Instead, wellbore fluid may be utilized as the fluid within the fluid reservoir 116. The barrel sub 118 can be configured to accept a one-way valve, which would allow wellbore fluid to enter (but not leave) the fluid reservoir 116 via the one-way valve. Filters may also be added to prevent debris present in the wellbore from entering the fluid reservoir 116.

A pump member is used to facilitate fluid and pressure communication between the barrel assembly 110 and mandrel assembly 150 below. For the current embodiment, the pump member is a plunger 123 that is connected to the bottom of the barrel sub 118. Further, the plunger 123 is press fit into the central bore of the barrel sub 118. In other embodiments, the plunger 123 may be threadedly connected to the barrel sub 118.

The interface between the mandrel assembly and the barrel assembly is such that the annulus formed between the exterior of the plunger 123 and the interior of the lower barrel 122 is not pressurized. Fluid channels in the barrel stop 127 are provided to allow wellbore fluid to travel freely in and out of the area. Therefore, the fluid pressure in this region is equal to the wellbore pressure at all times.

Located below the barrel assembly 110, is the mandrel assembly 150. The mandrel assembly 150 comprises a mandrel stop 152, mandrel 153, and bottom sub 155.

The mandrel 153 contains a bore that allows the plunger 123 of the barrel assembly 110 to slidably move along the axis of the pump 100 within the bore of the mandrel 153. The mandrel 153 also comprises a lower check valve 154, consisting of a ball, ball seat, spring, and spring seat. The lower check valve 154 is located at the bottom of the mandrel 153. A pressure chamber 121 comprising the volume bounded by the upper check valve 117, lower check valve 154, and the plunger 123 bore and mandrel 153 bore. During the operation of the pump 100, the size of the pressure chamber 121 varies as the pump 100 is reciprocated.

A bottom sub 155, constructed with two sets of threads, is threadedly connected to the bottom of the mandrel 153. One set of threads is designed to connect the mandrel to the bottom sub, while the second set of threads is designed to connect the mandrel assembly 150 to the anchor assembly 170 below.

Figure 3:
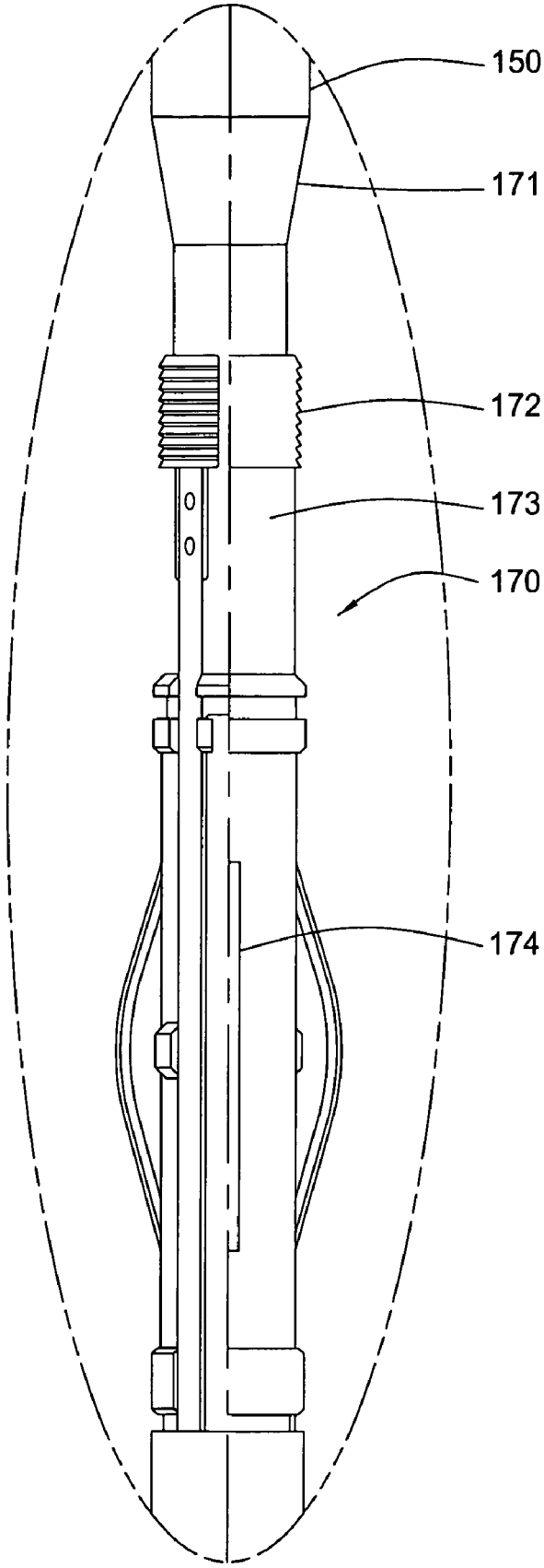
FIG. 3 is a cross-sectional view of one embodiment of an anchor assembly of the slickline pump of the present invention.

FIG. 3 illustrates one embodiment of an anchor assembly 170. The anchor assembly of this embodiment comprises a cone 171, anchor mandrel 173, centralizer springs 174 and slips 172. The purpose of the anchor assembly 170 is to hold the mandrel assembly 150, and the remainder of the work string assembly 40 below the anchor 170, stationary. In this manner, the anchor assembly 170 allows axial movement of the barrel assembly 110 (along with the work string assembly components above it) relative to the stationary mandrel assembly 150.

As illustrated in FIG. 3, slips 172 with teeth and bow springs 174 are disposed about the anchor sleeve 175. The anchor sleeve 175 slidably moves along the anchor mandrel 173. The anchor assembly 170 also includes a cone 171 at the top of the anchor mandrel 173. The slips 172 and bow springs 174 are constructed and arranged to mechanically grip the inside of the casing as the anchor sleeve 175 slidably moves up relative to the cone 171 and anchor mandrel 173. When the slips 172 and springs 174 sufficiently engage (prevent movement of the anchor 170) the casing, the anchor assembly is set.

In some embodiments, the anchor assembly 170 may be a set of spacers or tubular extensions without any gripping members. In other embodiments, the anchor assembly 170 may be left out altogether. In yet another embodiment, the hydraulic multipliers may be threadedly connected directly below the mandrel assembly, and the bottom sub may be left out altogether. The type of anchor assembly used depends upon factors such as the type of hardware already in the well, and the type of downhole tool being deployed.

Figure 5:
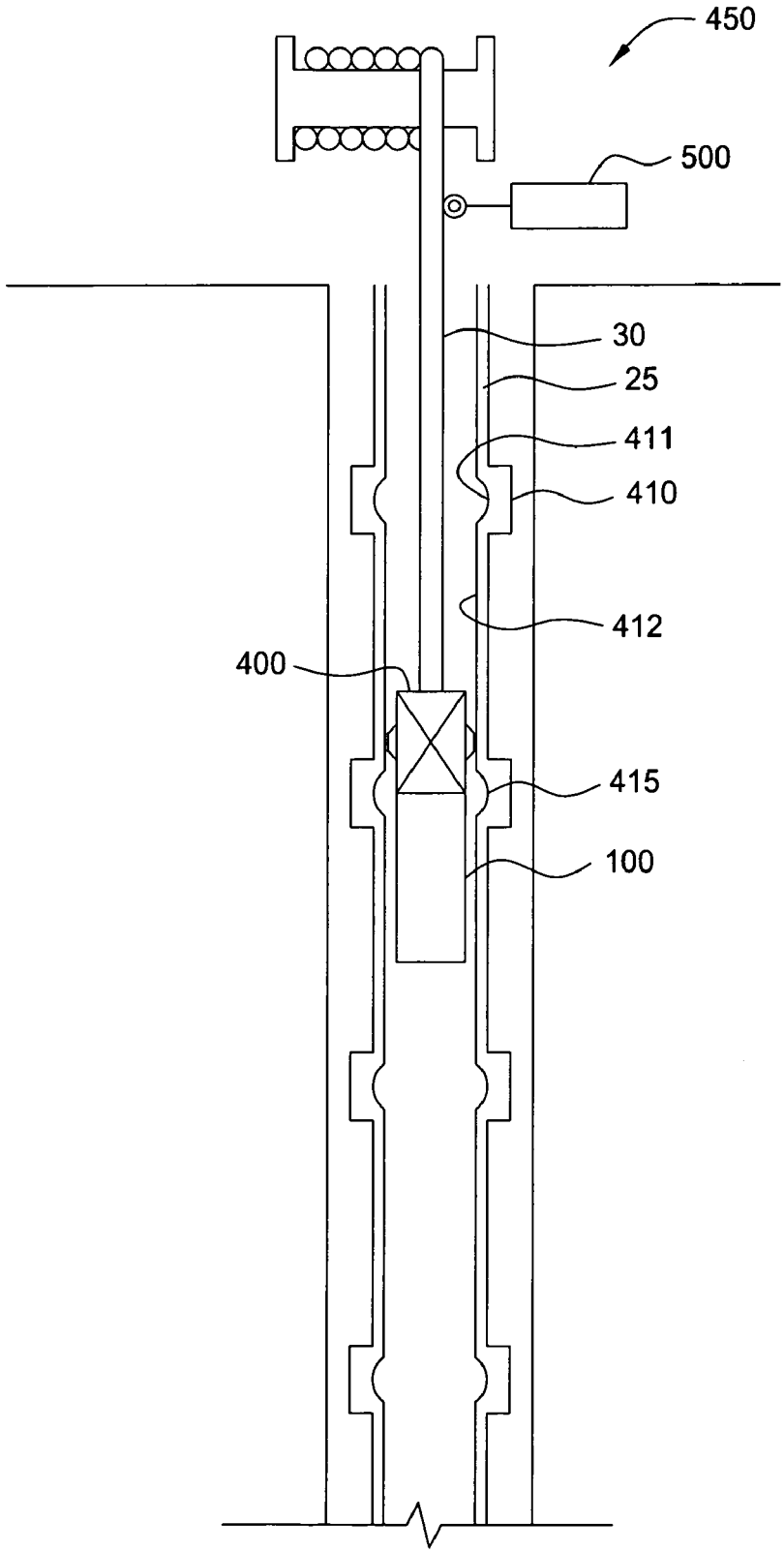
FIG. 5 is a cross-sectional view of one embodiment of a slickline pump and locator of the present invention.

Prior to setting the work string assembly 40 it is necessary to locate the assembly at a desired location in the wellbore 10. In wellbore operations it is often necessary to run casing 25 into the wellbore 10 in order to secure the wellbore 10 and isolate the formation 15 from the interior of the casing 25. The casing 25 assembles by coupling pipe joints together at the surface and running them into the wellbore. Typically, the pipe strings are coupled together in forty foot segments, or joints, however, it should be appreciated that any length joint could be used. A casing coupling 410, as shown in FIG. 5, is typically a threaded connection, but can also be welded connections. At each of the casing couplings 410 there is an irregular segment 415 on the interior of the casing 25. A casing log is often kept while running pipe strings into the wellbore. A casing log is kept by measuring the length of each pipe joint prior to coupling it to the casing string 25. This distance is recorded, and the number of pipe joints connected to the casing string 25 are recorded as they are put in place. Thus, an accurate log of the number and length of pipe joints that make up the casing string 25 is kept in the casing log.

Figure 6:
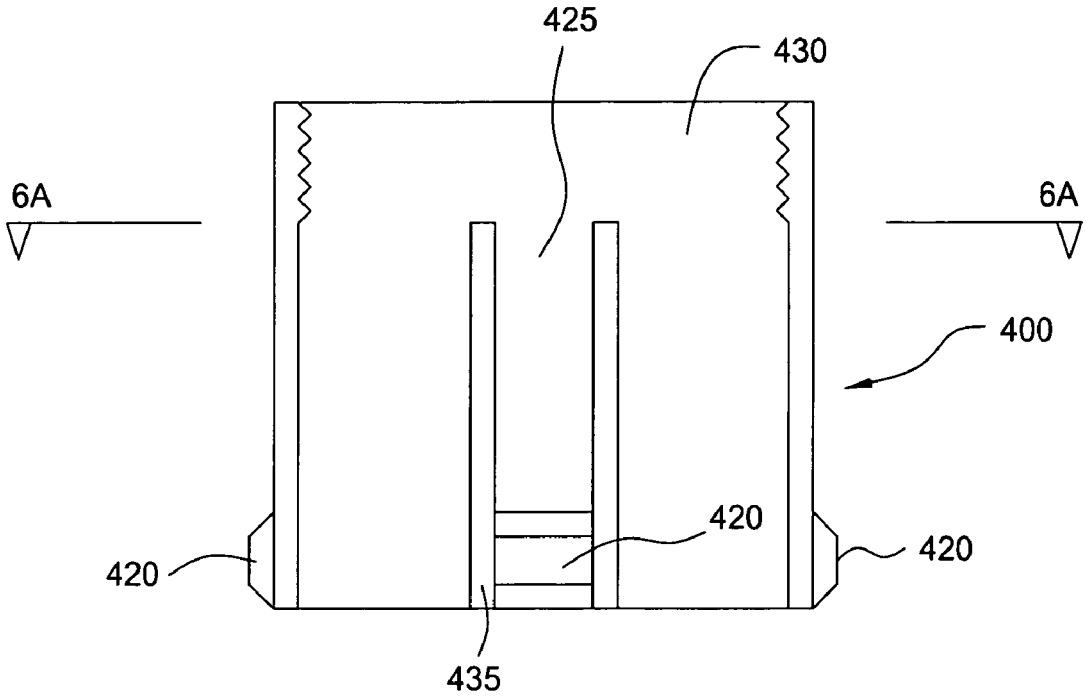
FIGS. 6 and 6*a* is front and top view of a typical locator of the present invention.
Figure 6A:
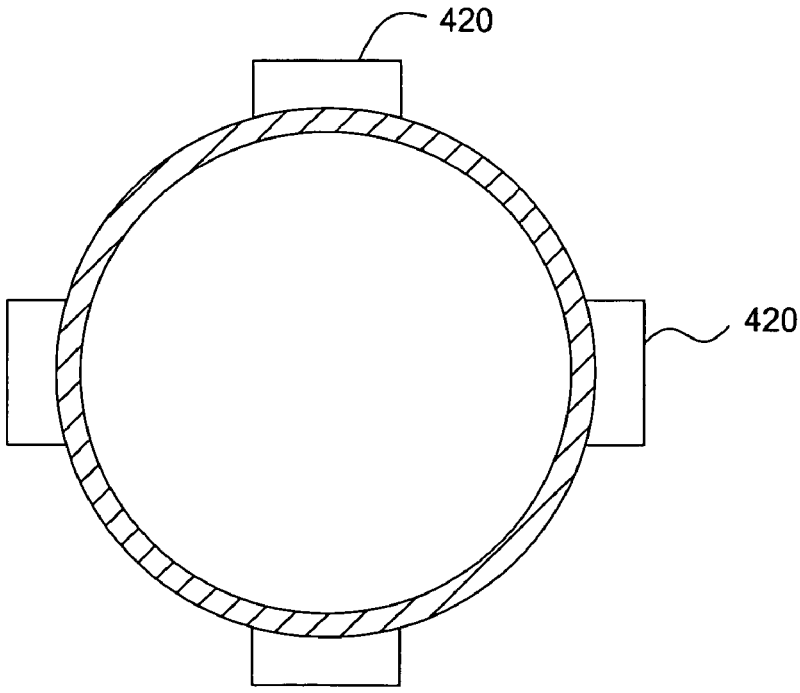
Figure 7:
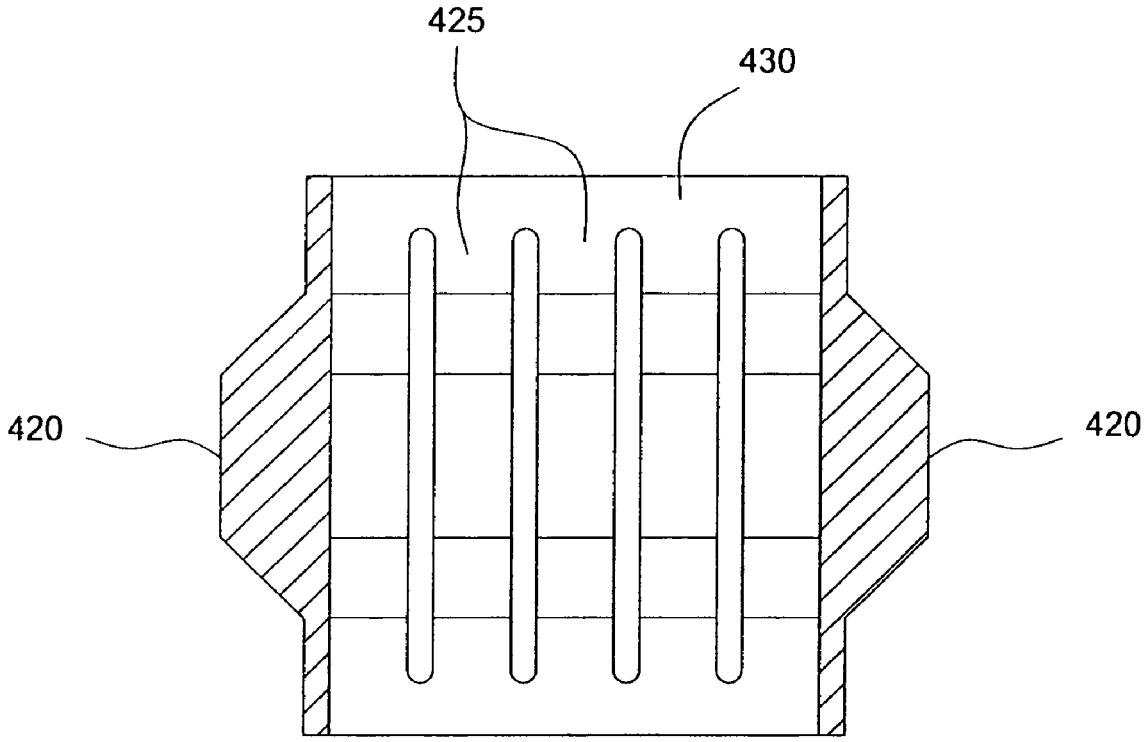
FIG. 7 is a front view of an alternative embodiment of the locator of the present invention.

If the location of workstring assembly 40 is desired, the locator 400 is connected to the workstring assembly 40. The locator 400 may be located at any location in the workstring assembly 40. As shown in FIG. 6, the locator 400 comprises a protrusion 420, a collet 430, and a flexible section 425. The flexible section 425 forms by forming grooves 435 into the collet 430 such that both sides of the flexible section 425 are free from the collet 430. Thus, the flexible section 425 has enough spring to bend in or out upon the protrusion 420 encountering irregularities in the casing 25 inner diameter. There are four flexible sections 425 and protrusions 420 shown in FIGS. 6 and 6*a*, however it will be appreciated that any number of flexible sections 425 may be used. An alternative embodiment of the locator 400 is shown in FIG. 7 and includes protrusions 420 and flexible sections 425 formed substantially in the middle of the collet 430. Further, the protrusions could be of any formation so long as the protrusions 420 extend beyond the outer diameter of the collet 430 and are attached to the collet to allow flexibility. Further, the collet 430 could be a conventional electromagnetic detection sensor, which detects the increased mass at each casing coupling 410.

In operation, the workstring assembly 40 with the locator 400 lowers into the cased wellbore 10. The locator 400 is sized so that the outer diameter of the protrusions 420 are slightly larger than the inner diameter of the casing 25. Thus, upon the locator 400 entering the casing 25 the protrusion 420 force the flexible section 425 to bend inward. As the workstring assembly 40 travels down the casing 25, the protrusions 420 are in contact with the casing inner wall 412, shown in FIG. 5. The workstring assembly 40 reaches a casing coupling 410 and the protrusion 420 pushes against the irregular inner wall of the casing 411. When the protrusion hits the enlarged inner diameter of the coupling 410 a detectable change in slick line 30 tension is created. This detection is recorded and used to determine the number of couplings 410 passed by the workstring assembly 40. The protrusion 420 quickly returns to the previous position as the workstring assembly 40 continues down the wellbore 10. At the surface each time the locator 400 encounters a casing coupling 410 it is recorded. In order to measure the location downhole, the number of casing couplings 410 is compared to the casing log. If additional accuracy is desired a calibrated measuring wheel 500 can measure the cable 30 as it is unspoolled.

Figure 4A:
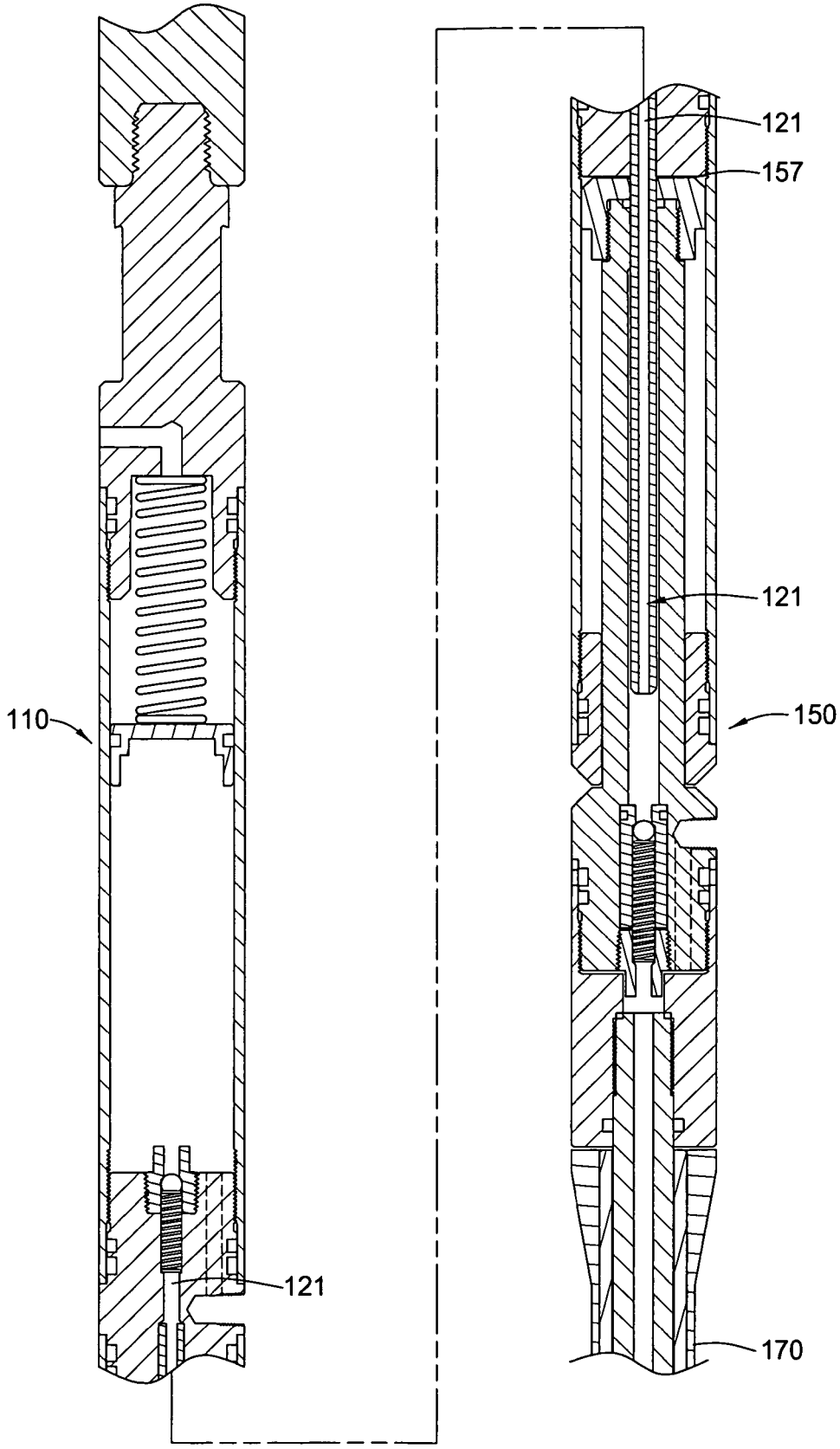
FIG. 4A is a cross-sectional view of the slickline pump in the fully compressed position.
Figure 4B:
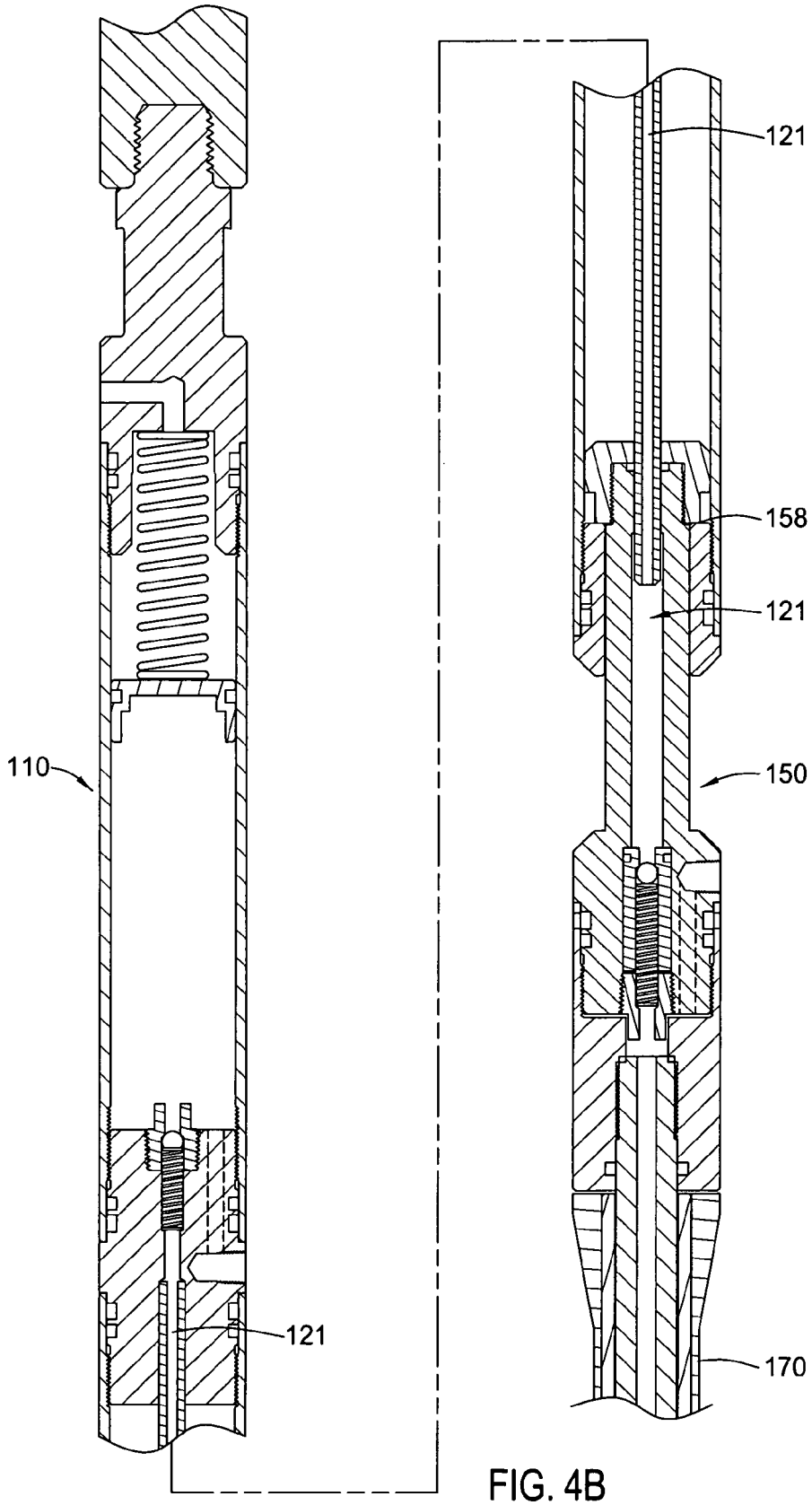
FIG. 4B is a cross-sectional view of the slickline pump in the fully extended position.

In operation, the slickline pump reciprocates between the compressed and extended positions, as illustrated in FIGS. 4A and 4B. Prior to the actuation of the pump 100, however, the workstring assembly 40 (shown in FIG. 1) is lowered to the desired position and the anchor assembly is set. After the anchor assembly is set, relative axial movement between the barrel assembly and the mandrel assembly is possible. The slickline pump 100 can be operated by reciprocating the slickline. As described earlier, any required downforce, for setting the anchor assembly or reciprocating the tool is provided by using a technique of utilizing weight stem members and varying the amount of tension in the slickline.

In response to the movement of the slickline and weight stem members above, the barrel assembly reciprocates relative to the mandrel assembly along the longitudinal axis of the tool. The reciprocated motion comprises a series of alternating upstrokes and downstrokes. In this specification, the term downstroke refers to motion of the pump towards the compressed position, while upstroke refers motion of the pump towards the extended position.

In order to produce an upstroke, the tension in the slickline needs to be slightly greater than the weight of the weight stem. If the slickline is under too much tension, however, the entire work string assembly, including the anchor assembly all components below, may by pulled uphole and out of the desired position. In order to produce a downstroke, tension in the slickline is reduced to less than the weight of the weight stem members. This way, the weight stem imparts a downward force on the barrel assembly of the pump 100.

FIG. 4A illustrates the slickline pump 100 in the completely compressed position. During the downstroke, the pressure chamber's 121 volume is decreased, which, in turn, causes the pressure in the chamber 121 to significantly increase. The increased pressure in the chamber 121 forces the upper check valve 117 to remain closed, but the lower check valve 154 opens allowing the region below to be pressurized to the same pressure as that in the chamber 121. The lower check valve 154 remains open until the end of the downstroke. The end of the downstroke is reached when the downward motion of the barrel assembly is impeded as the bottom shoulder of the barrel sub 118 comes in contact with the upper surface 157 of the mandrel stop.

FIG. 4B illustrates the slickline pump 100 in the completely extended position. During the upstroke, the volume comprising the pressure chamber 121 increases and, correspondingly, the pressure in the chamber 121 drops below the pressure in the fluid reservoir 116. Consequently, the lower check valve 154 remains closed, but the upper check valve 117 opens allowing fluid to flow from the reservoir 116 to the pressure chamber 121. The upper check valve 117 remains open until the end of the upstroke. The end of the upstroke is reached when the upper surface of the barrel stop 127 comes in contact with the mandrel stop's lower surface 158.

As the pump 100 reciprocates, it continues to transfer pressurized fluid to the components of the work string assembly below. The fluid pressure is further increased via the hydraulic multipliers. Once the fluid pressure is increased adequately, the downhole tool included in the work string assembly can be deployed and actuated as desired.

While the foregoing is directed to embodiments of the present invention, other and further embodiments of the invention may be devised without departing from the basic scope thereof, and the scope thereof is determined by the claims that follow.

The invention claimed is:

1. A method of locating a tool in a wellbore comprising:

providing an assembly comprising:

the tool;

a pump; and a locator configured to detect a casing coupling in a casing string;

running the assembly into the wellbore on a conveyance string selected from a group consisting of slickline, braided line, wireline, swab line, and combinations thereof;

monitoring the detection of couplings by the locator;

measuring a length of the conveyance string deployed;

correlating the measuring and the monitoring to determine the location of the assembly in the wellbore; and axially reciprocating the conveyance string thereby causing the pump to direct a fluid to the tool in order to actuate the tool at a desired depth.

2. The method of claim 1, wherein the locator measures the location of the tool by transmitting an indicator to the surface when the casing coupling is encountered and further including counting the number of casing couplings.

3. The method of claim 2, wherein the locator is a collar having one or more protrusions for engaging an inner diameter of the casing.

4. The method of claim 1, further comprising actuating an anchor to hold the assembly in place prior to actuating the tool.

5. The method of claim 4, further comprising the pump transferring energy by reciprocating a plunger in the pump.

6. The method of claim 5, further comprising reciprocating the plunger by increasing and decreasing the tension in the conveyance string.

7. The method of claim 1, wherein the fluid comprises hydraulic fluid.

8. The method of claim 7, wherein the pump includes a fluid reservoir configured to store the hydraulic fluid.

9. An apparatus for locating a tool in a wellbore comprising:

a conveyance string selected from a group consisting of slickline, braided line, wireline, swab line, and combinations thereof; and a workstring assembly attached to the conveyance string, the workstring assembly comprising:

the tool;

a pump having:

a fluid reservoir configured to store hydraulic fluid which is filled into the reservoir prior to locating the tool in the wellbore;

a chamber;

a piston to compress the chamber, wherein the piston is operated in response to axial reciprocation of the conveyance string; and a locator for identifying a feature in the wellbore, wherein the locator comprises a collar with one or more protrusions for engaging an inner diameter of the casing and the protrusions are attached to the collar by a flexible member.

10. The apparatus of claim 9, wherein the tool is a packer.

11. The apparatus of claim 9, further comprising a weight component for actuating the pump.

12. The apparatus of claim 9, wherein the pump is configured to direct fluid exiting the pump to the tool, wherein the fluid comprises hydraulic fluid.

13. A method of locating a tool in a wellbore comprising:

providing an assembly comprising:

a pump having a chamber and a piston to compress the chamber; and a locator configured to detect a casing coupling in a casing string;

conveying the assembly into the wellbore on a conveyance string, wherein the conveyance string is selected from a group consisting of slickline, braided line, wireline, swab line, and combinations thereof;

monitoring the detection of couplings by the locator;

measuring a length of the conveyance string deployed;

correlating the measuring and the monitoring to determine the location of the assembly in the wellbore; and axially reciprocating the conveyance string thereby causing the pump to direct a fluid to the tool in order to actuate the tool at a desired depth.

14. The method of claim 13, further including transmitting an indicator to the surface when a casing coupling is encountered and further including counting the number of casing couplings.

15. The method of claim 13, further comprising the pump transferring energy by reciprocating a plunger in the pump.

16. The method of claim 15, further comprising reciprocating the plunger by increasing and decreasing the tension in the conveyance string.

17. The method of claim 13, wherein the fluid comprises hydraulic fluid.

18. An apparatus for locating a tool in a wellbore comprising:

a conveyance string selected from a group consisting of slickline, braided line, wireline, swab line, and combinations thereof; and a workstring assembly attached to the conveyance string, the workstring assembly comprising:

the tool, a pump having a chamber and a piston to compress the chamber, wherein the piston is operated in response to axial reciprocation of the conveyance string, the pump further having a fluid reservoir configured to store hydraulic fluid which is filled into the reservoir prior to locating the tool in the wellbore; and a locator having a collar with one or more protrusions for engaging an inner diameter of the casing, wherein the protrusions are attached to the collar by a flexible member.

19. The apparatus of claim 18, wherein the pump is configured to direct fluid exiting the pump to the tool, wherein the fluid comprises hydraulic fluid.

20. The apparatus of claim 18, wherein the tool is a packer.

21. An apparatus for locating a tool in a wellbore comprising:

a conveyance string selected from a group consisting of slickline, braided line, wireline, swab line, and combinations thereof; and a workstring assembly attached to the conveyance string, the workstring assembly comprising:

the tool, a pump having a piston that moves within a chamber in response to axial reciprocation of the conveyance string, the pump further having a fluid reservoir configured to store hydraulic fluid which is filled into the reservoir prior to locating the tool in the wellbore; and a locator having a collar with one or more protrusions for engaging an inner diameter of the casing.

* * * * *